US009518384B2

(12) United States Patent
Kashirajima et al.

(10) Patent No.: US 9,518,384 B2
(45) Date of Patent: Dec. 13, 2016

(54) FLUSH TOILET

(71) Applicant: TOTO LTD., Kitakyushu-shi, Fukuoka (JP)

(72) Inventors: Shu Kashirajima, Kitakyushu (JP); Tomohiro Hirakawa, Kitakyushu (JP); Masaki Kitamura, Kitakyushu (JP); Yuki Shinohara, Kitakyushu (JP); Yuki Shimokawa, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 167 days.

(21) Appl. No.: 14/634,153

(22) Filed: Feb. 27, 2015

(65) Prior Publication Data

US 2015/0275494 A1 Oct. 1, 2015

(30) Foreign Application Priority Data

Mar. 28, 2014 (JP) ..... 2014-069460

(51) Int. Cl.
*E03D 11/00* (2006.01)
*E03D 11/02* (2006.01)
*E03D 11/08* (2006.01)

(52) U.S. Cl.
CPC ..... *E03D 11/02* (2013.01); *E03D 11/08* (2013.01)

(58) Field of Classification Search
CPC ..... E03D 11/02; E03D 11/13
USPC ..... 4/420, 421, 425
See application file for complete search history.

(56) References Cited

U.S. PATENT DOCUMENTS 5,918,325 A * 7/1999 Arita et al. ..... E03D 11/02 4/420
2003/0140406 A1* 7/2003 Miwa ..... E03D 11/02 4/420
2005/0000007 A1* 1/2005 Cummings ..... E03C 1/122 4/421
2014/0289947 A1* 10/2014 Hirakawa ..... E03D 11/08 4/421
2015/0082531 A1* 3/2015 Kashirajima ..... E03D 11/08 4/420

* cited by examiner

*Primary Examiner* — Huyen Le
(74) *Attorney, Agent, or Firm* — Brooks Kushman P.C.

(57) ABSTRACT

A flush toilet includes: a bowl portion having a waste-receiving surface, a rim and a recess; a rim spout portion configured to spout flush water to form a swirl flow which swirlingly flows along the inner peripheral surface; a drainage conduit having an inlet connecting with the recess to discharge waste therethrough, wherein the waste-receiving surface of the bowl portion is composed of a left waste-receiving sub-surface and a right waste-receiving sub-surface defined, respectively, on both sided of a center line with respect to a lateral direction of the bowl portion, the left waste-receiving sub-surface and the right waste-receiving sub-surface are formed, respectively, in different shapes in a front region of the bowl portion so as to allow flush water spouted from the rim spout portion to form a major stream which flows from a front end of the bowl portion into the recess.

7 Claims, 8 Drawing Sheets

FLUSH TOILET

CROSS-REFERENCE TO RELATED APPLICATIONS

This application claims priority to JP application JP 2014-069460 filed on Mar. 28, 2014 the disclosures of which is incorporated in its entirety by reference herein.

TECHNICAL FIELD

The present invention relates to a flush toilet, and more particularly to a flush toilet capable of improving waste discharge performance.

BACKGROUND

As a flush toilet capable of flushing a toilet main unit with flush water supplied from a flush water source to thereby discharge waste, there has heretofore been known one type in which flush water is spouted from two rim spout ports, i.e., first and second spout ports for rim water, and supplied onto a waste-receiving surface of a bowl portion in the form of a swirling flow, as described, for example, in JP 2011-157738A (Patent Document 1). This flush toilet is configured to allow flush water flowing out of the first spout port to flow downwardly after passing through a front end of the bowl portion, and flow from the front end toward an inlet of a drainage trap. The flush toilet is also configured to allow flush water flowing out of the second spout port to be directly supplied toward the inlet of the drainage trap while flowing downwardly along a rearwardly-convexed curved surface continuous with a rear region of a standing surface of the bowl portion.

As a conventional flush toilet, there has also been known a flush toilet in which flush water spouted from a first spout portion for rim water flows along a shelf, and, after swirlingly flowing downwardly while flushing (cleaning) a waste-receiving surface of a bowl portion, flows into a bottom of the bowl, and water spouted from a second spout portion for jet water flows downwardly into the bottom of the bowl portion to agitate pooled water within the bowl portion in an up-down direction, as described, for example, in JP 5223988B (Patent Document 2). In this flush toilet, with a view to allowing flush water to vigorously flow from a front end of the bowl portion toward an inlet of a drainage trap, a recess is formed in a front region of the waste-receiving surface.

SUMMARY

However, the flush toilet described in the Patent Document 1 a flow rate of flush water flowing from the front end of the bowl portion to the inlet of the drainage trap is likely to become insufficient, thereby causing a problem of failing to sufficiently discharge waste.

In the flush toilet described in the Patent Document 2, the recess formed in the front region of the waste-receiving surface may be deemed as means to increase a flow rate of flush water from the front end of the bowl portion toward the inlet of the drainage trap. However, the recess formed in the front region of the waste-receiving surface gives rise to a problem that waste adheres to and remains in a bent area of the recess having difficulty in waste flushing.

Therefore, the present invention has been made to solve the conventional problems and a an object thereof is to provide a flush toilet capable of sufficiently flushing waste without causing waste to remain inside a bowl portion, and efficiently discharging waste in the bowl portion into a drainage conduit, thereby improving waste discharge performance.

In order to achieve the above object, the present invention provides a flush toilet which is capable of flushing a toilet main unit with flush water supplied from a flush water source to thereby discharge waste. The flush toilet comprises: a bowl portion having a bowl-shaped waste-receiving surface, a rim located along an upper edge thereof, and a recess formed below the waste-receiving surface, wherein the recess has a bottom located below a pooled water level, and a peripheral wall connecting between the bottom and a lower edge of the waste-receiving surface; a rim spout portion configured to spout flush water along an inner peripheral surface of the rim exposed to an internal space of the bowl portion to form a swirl flow which swirlingly flows along the inner peripheral surface; a drainage conduit having an inlet connecting with the recess to discharge waste therethrough, wherein the waste-receiving surface of the bowl portion is composed of a left waste-receiving sub-surface and a right waste-receiving sub-surface defined, respectively, on both sided of a center line with respect to a lateral direction of the bowl portion, and wherein the left waste-receiving sub-surface and the right waste-receiving sub-surface are formed, respectively, in different shapes in a front region of the bowl portion so as to allow flush water spouted from the rim spout portion to form a major stream which flows from a front end of the bowl portion into the recess.

In the above flush toilet of the present invention, the waste-receiving surface of the bowl portion is composed of a left waste-receiving sub-surface and a right waste-receiving sub-surface defined, respectively, on both sided of a center line with respect to a lateral direction of the bowl portion, wherein the left waste-receiving sub-surface and the right waste-receiving sub-surface are formed, respectively, in different shapes in a front region of the bowl portion so as to allow flush water spouted from the rim spout portion to form a major stream which flows from a front end of the bowl portion into the recess. Thus, it becomes possible to increase a flow rate of a major stream of flush water flowing from the front end of the bowl portion into the recess and then flowing toward the inlet of the drainage conduit. This makes it possible to sufficiently flush waste without causing waste to remain inside the bowl portion, and efficiently discharge waste in the bowl portion into a drainage conduit, thereby improving waste discharge performance.

Preferably, in the flush toilet of the present invention, one of the left waste-receiving sub-surface and the right waste-receiving sub-surface of the waste-receiving surface is a first waste-receiving sub-surface defined on one of the sides which is provided with the rim spout portion, and a remaining one of the left waste-receiving sub-surface and the right waste-receiving sub-surface of the waste-receiving surface is a second waste-receiving sub-surface on the other side devoid of the rim spout portion, wherein the second waste-receiving sub-surface is formed at a height position lower than the first waste-receiving sub-surface.

In this preferred embodiment, one of the left waste-receiving sub-surface and the right waste-receiving sub-surface of the waste-receiving surface is a first waste-receiving sub-surface defined on one of the sides which is provided with the rim spout portion, and a remaining one of the left waste-receiving sub-surface and the right waste-receiving sub-surface of the waste-receiving surface is a second waste-receiving sub-surface on the other side devoid of the rim spout portion, wherein the second waste-receiving sub-surface is formed at a height position lower than the first waste-receiving sub-surface. Thus, it becomes possible to increase a flow rate of a major stream of flush water flowing into the recess after passing through the front end of the bowl portion and then obliquely flowing toward the inlet of the drainage conduit. This makes it possible to efficiently discharge waste in the bowl portion into a drainage conduit, thereby improving waste discharge performance.

More preferably, each of the first waste-receiving sub-surface and the second waste-receiving sub-surface is joined to the recess, wherein the first waste-receiving sub-surface and the second waste-receiving sub-surface are formed such that a curvature radius of a joining area between the second waste-receiving sub-surface and the recess becomes greater than a curvature radius of a joining area between the first waste-receiving sub-surface and the recess.

In this preferred embodiment, each of the first waste-receiving sub-surface and the second waste-receiving sub-surface is joined to the recess, wherein the first waste-receiving sub-surface and the second waste-receiving sub-surface are formed such that a curvature radius of a joining area between the second waste-receiving sub-surface and the recess becomes greater than a curvature radius of a joining area between the first waste-receiving sub-surface and the recess. Thus, it becomes possible to increase a flow rate of a major stream of flush water flowing into the recess after passing through the front end of the bowl portion and then obliquely flowing toward the inlet of the drainage conduit. This makes it possible to efficiently discharge waste in the bowl portion into a drainage conduit, thereby improving waste discharge performance.

Preferably, in the flush toilet of the present invention, the waste-receiving surface is formed to, along a line approximately equally distant from the rim in an intermediate region of the waste-receiving surface in its longitudinal direction, extend toward the front end of the bowl portion while gradually inclining downwardly.

In this preferred embodiment, the waste-receiving surface is formed to, along a line approximately equally distant from the rim in an intermediate region of the waste-receiving surface in its longitudinal direction, extend toward the front end of the bowl portion while gradually inclining downwardly, so that it becomes possible to sufficiently flush waste without causing waste to remain inside the bowl portion, and increase a flow rate of a major stream of flush water flowing from the front end of the bowl portion into the recess and then flowing toward the inlet of the drainage conduit. This makes it possible to efficiently discharge waste in the bowl portion into a drainage conduit, thereby improving waste discharge performance.

Preferably, in the flush toilet of the present invention, the rim spout portion comprises: a first rim spout portion located on one of laterally opposite sides of the bowl portion, and configured to spout flush water toward the front end of the bowl portion to form a swirl flow which swirlingly flows along the inner peripheral surface of the rim; and a second rim spout portion located on the other side of the bowl portion, and configured to spout flush water to form a swirl flow having the same flow direction as that of the swirl flow formable by the first rim spout portion.

In this preferred embodiment, the rim spout portion comprises: a first rim spout portion located on one of laterally opposite sides of the bowl portion, and configured to spout flush water toward the front end of the bowl portion to form a swirl flow which swirlingly flows along the inner peripheral surface of the rim; and a second rim spout portion located on the other side of the bowl portion, and configured to spout flush water to form a swirl flow having the same flow direction as that of the swirl flow formable by the first rim spout portion. Thus, it becomes possible to sufficiently flush waste without causing waste to remain inside the bowl portion, and increase a flow rate of a major stream of flush water flowing from the front end of the bowl portion into the recess and then flowing toward the inlet of the drainage conduit. This makes it possible to efficiently discharge waste in the bowl portion into a drainage conduit, thereby improving waste discharge performance.

More preferably, the first rim spout portion and the second rim spout portion are configured to allow flush water spouted from the second rim spout portion to flow into the recess from a lateral side of the bowl portion and then merge with a major stream formed by the first rim spout portion, from a transverse direction of the recess at a position on a lower side of the major stream.

In this preferred embodiment, the first rim spout portion and the second rim spout portion are configured to allow flush water spouted from the second rim spout portion to flow into the recess from a lateral side of the bowl portion and then merge with a major stream formed by the first rim spout portion, from a transverse direction of the recess at a position on a lower side of the major stream. Thus, it becomes possible to effectively generate a flow for agitating pooled water within the recess in an up-down direction. This makes it possible to efficiently discharge waste in the bowl portion into a drainage conduit in cooperation with the major stream flowing from the front end of the bowl portion toward the inlet of the drainage conduit, thereby improving waste discharge performance.

More preferably, the waste-receiving surface of the bowl portion has a rear region including a rear waste-receiving sub-surface located adjacent to and on a downstream side of the second rim spout portion and formed in a shelf shape, wherein the rear waste-receiving sub-surface is configured to, when flush water spouted from the second rim spout portion flows thereon, guide the flush water to a front region of the recess.

In this preferred embodiment, the waste-receiving surface of the bowl portion has a rear region including a rear waste-receiving sub-surface located adjacent to and on a downstream side of the second rim spout portion and formed in a shelf shape, wherein the rear waste-receiving sub-surface is configured to, when flush water spouted from the second rim spout portion flows thereon, guide the flush water to a front region of the recess. Thus, it becomes possible to more effectively generate a flow for agitating pooled water within the recess in the up-down direction. This makes it possible to efficiently discharge waste in the bowl portion into a drainage conduit in cooperation with the major stream flowing from the front end of the bowl portion toward the inlet of the drainage conduit, thereby improving waste discharge performance.

The flush toilet of the present invention can sufficiently flush waste without causing waste to remain inside a bowl portion, and efficiently discharge waste in the bowl portion into a drainage conduit, thereby improving waste discharge performance.

DETAILED DESCRIPTION

With reference to the accompanying drawings, a flush toilet according to one embodiment of the present invention will now be described.

Figure 1:
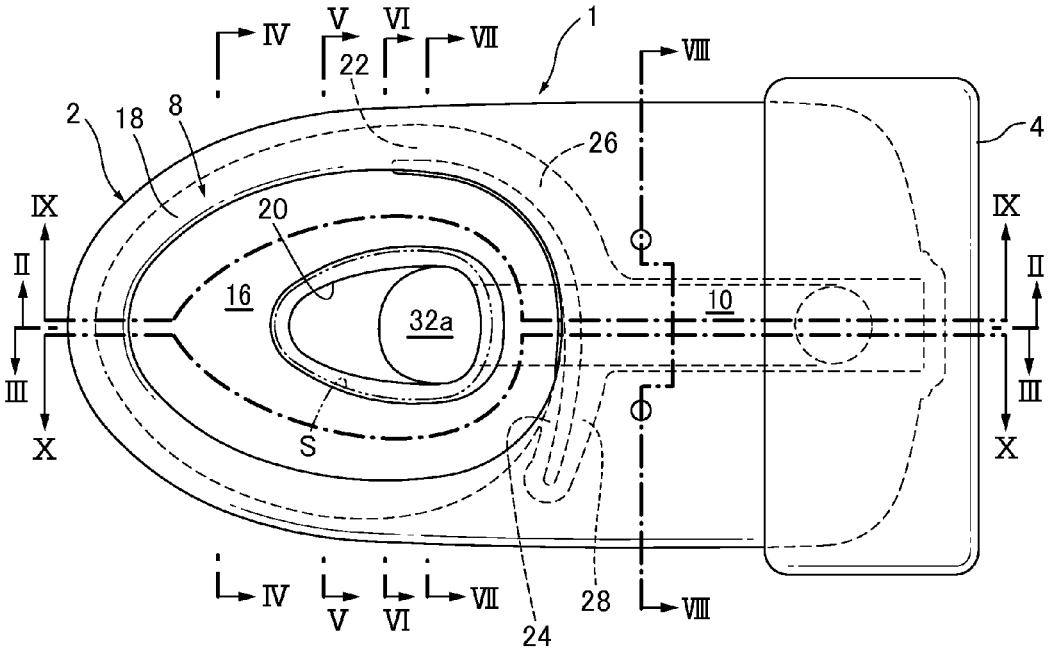
FIG. 1 is a top plan view illustrating a flush toilet according to one embodiment of the present invention.
Figure 2:
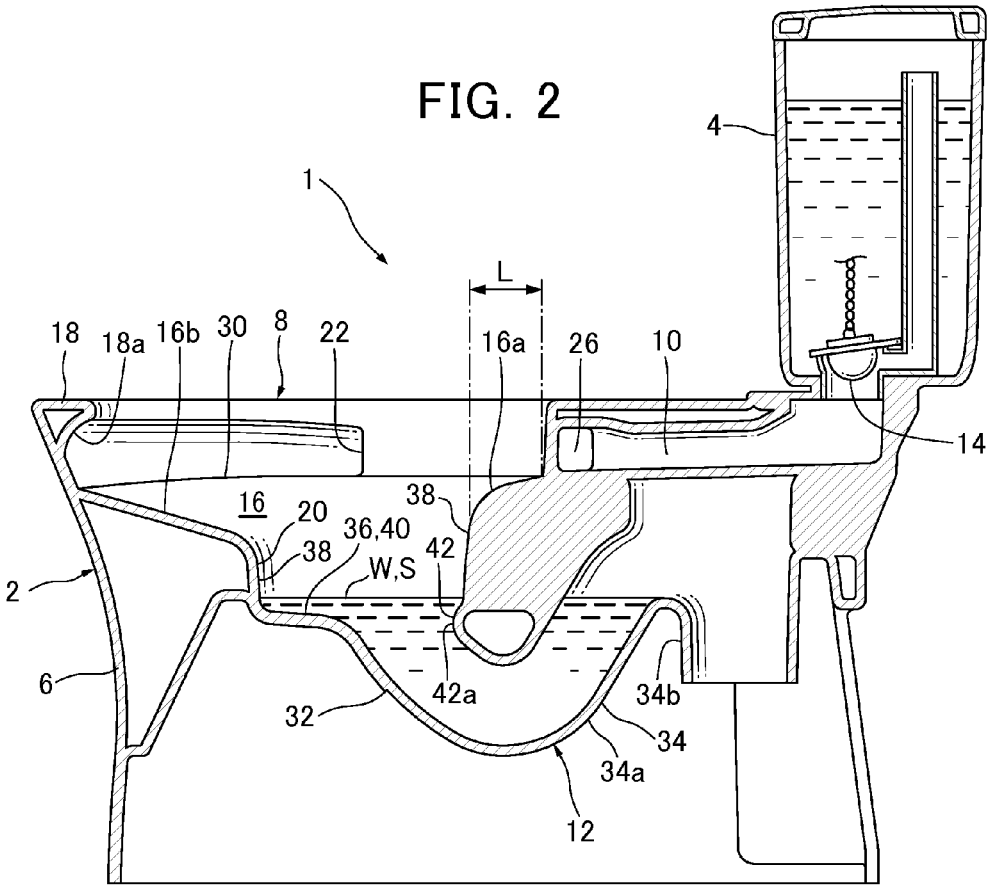
FIG. 2 is a sectional view taken along the line II-II in FIG. 1.
Figure 3:
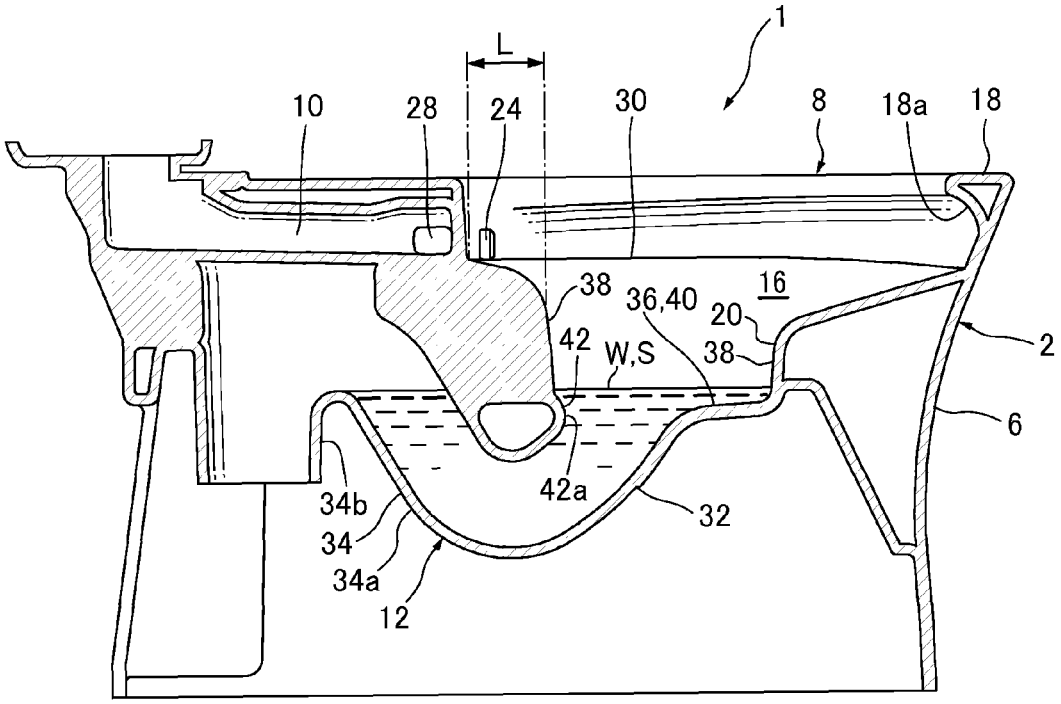
FIG. 3 is a sectional view taken along the line III-III in FIG. 1.
Figure 4:
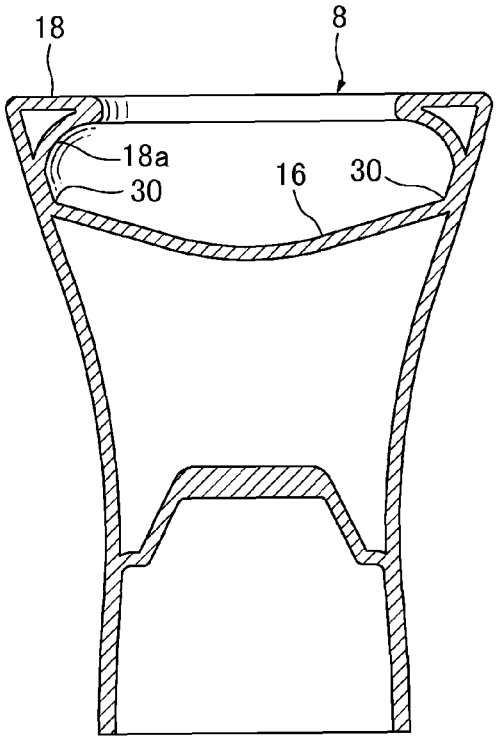
FIG. 4 is a sectional view taken along the line IV-IV in FIG. 1.
Figure 5:
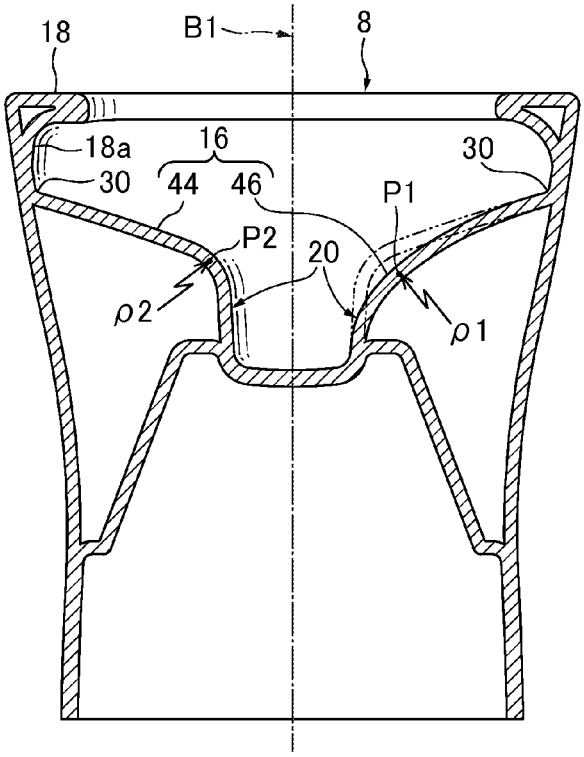
FIG. 5 is a sectional view taken along the line V-V in FIG. 1.
Figure 6:
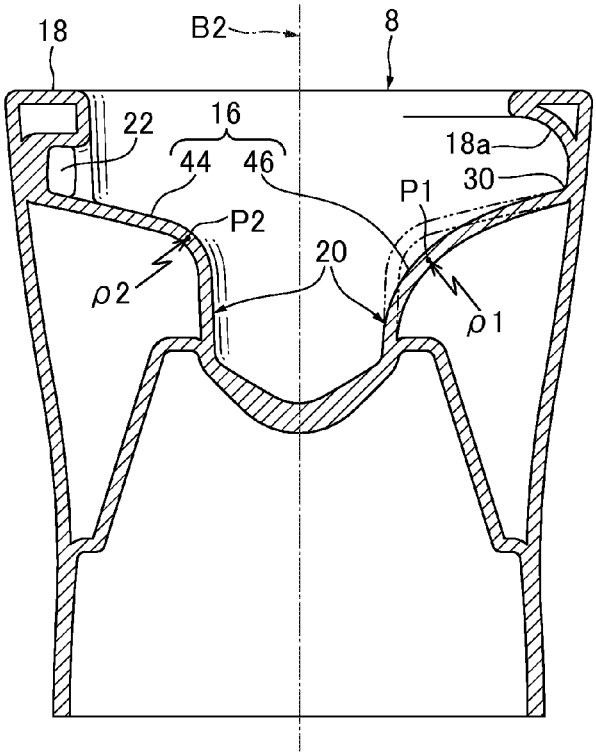
FIG. 6 is a sectional view taken along the line VI-VI in FIG. 1.
Figure 7:
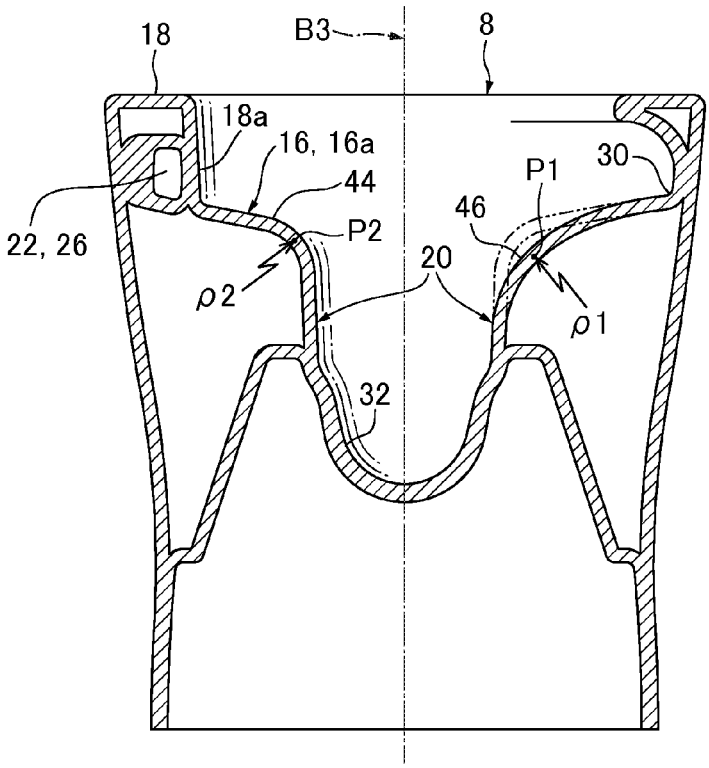
FIG. 7 is a sectional view taken along the line VII-VII in FIG. 1.
Figure 8:
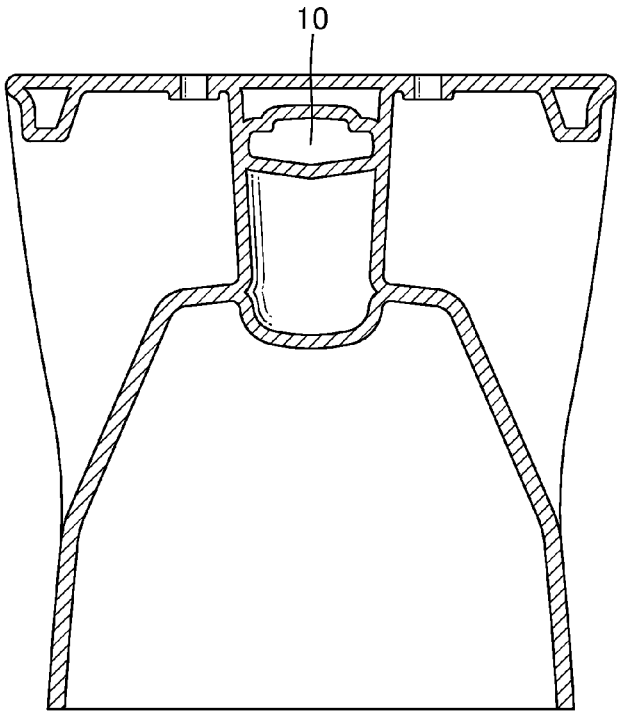
FIG. 8 is a sectional view taken along the line VIII-VIII in FIG. 1.

First of all, with reference to FIGS. 1 to 8, a fundamental structure of the flush toilet according to this embodiment will be described. FIG. 1 is a top plan view illustrating the flush toilet according to this embodiment, and FIG. 2 and FIG. 3 are, respectively, a sectional view taken along the line II-II in FIG. 1 and a sectional view taken along the line III-III in FIG. 1. FIG. 4, FIG. 5 and FIG. 6 are, respectively, a sectional view taken along the line IV-IV in FIG. 1, a sectional view taken along the line V-V in FIG. 1 and a sectional view taken along the line VI-VI in FIG. 1. FIG. 7 is a sectional view taken along the line VII-VII in FIG. 1, and FIG. 8 is a sectional view taken along the line VIII-VIII in FIG. 1.

As illustrated in FIGS. 1 and 3, the flush toilet 1 is a wash-down toilet configured to wash down waste by an action of flowing water arising from a water head difference within a bowl portion, wherein it comprises a toilet main unit 2, and a reservoir tank 4 which stores therein flush water for flushing the toilet main unit 2. The toilet main unit 2 is a porcelain product having a glaze layer formed on a surface thereof, wherein it has a lower section formed as a skirt 6, and an upper section having a front half formed as a bowl portion 8. The upper section also has a rear half in which an upper area thereof is formed with a common water flow passage 10 having an upstream end communicating with the reservoir tank 4, and a lower area thereof is formed with a drainage conduit 12 for discharging waste therethrough.

The reservoir tank 4 serves as a flush water source. The reservoir tank 4 is internally provided with a discharge valve 14 configured to be opened and closed by a manual operation lever (not illustrated). It is to be understood that, as the flush toilet according to this embodiment, it is possible to use a direct-pressure flush toilet of a type which is devoid of the reservoir tank 4 and in which flush water is directly supplied from a city water line, a flush toilet of a type in which flush water is supplied via a flush valve, and others.

The bowl portion 8 has a bowl-shaped waste-receiving surface 16 (details thereof will be described later), a rim 18 located along an upper edge thereof, and a recess 20 formed below the bowl-shaped waste-receiving surface 16. In this embodiment, as illustrated in FIGS. 2 to 7, the rim 18 is formed such that an aftermentioned inner peripheral surface 18*a* thereof has an inwardly overhanging shape to prevent flush water being swirlingly flowing from jumping out of the rim 18.

The toilet main unit 2 is formed with a first spout port 22 and a second spout port 24 each for spouting flush water therefrom, wherein the first spout port 22 is provided at a position slightly rearward of a mid region in a left (in front view) half of the inner peripheral surface of the rim 18 of the bowl portion 8, and the second spout port 24 is provided in a rear region in a right (in front view) half (in a downstream region) of the inner peripheral surface of the rim 18. That is, the first spout port 22 is located on a left side of the bowl portion 8 in a right-left (lateral) direction thereof, and configured to spout flush water toward a front end of the bowl portion 8 to form a swirl flow which swirlingly flows along an inner peripheral surface 18*a* of the rim 18 exposing to an internal space of the bowl portion 8.

On the other hand, the second spout port 24 is located on a right side of the bowl portion 8 in the lateral direction, and configured to spout flush water onto the inner peripheral surface 18*a* of the rim 18 to form a swirl flow which swirlingly flows in the same direction as that of the swirl flow formable by the first spout port 22.

The common water flow passage 10 formed in the upper area of the rear half of the flush toilet 1 is branched into a first water flow passage 26 and a second water flow passage 28 each extending in a forward direction of the toilet main unit. The first water flow passage 26 is configured to supply flush water to the first spout port 22, and the second water flow passage 28 is configured to supply flush water to the second spout port 24.

In the flush toilet 1 according to this embodiment, the first water flow passage 26 including the first spout port 22, and the second water flow passage 28 including the second spout port 24, are integrally formed with the porcelain toilet main unit 2. However, the present invention is not limited to this configuration, but the first water flow passage 26 including the first spout port 22 and the second water flow passage 28 including the second spout port 24 may be formed by providing a distributor or the like as a component separate from the toilet main unit.

In the flush toilet 1 according to this embodiment, as illustrated in FIGS. 2 to 7, the waste-receiving surface 16 of the bowl portion 8 is formed in an upwardly convexed shape over the entire region thereof, along radial lines oriented toward an inlet of the drainage conduit 12.

Further, as illustrated in FIGS. 2 and 3, the bowl portion 8 has a water guide channel 30 formed in a region just below the inner peripheral surface 18*a* of the rim 8 to guide flush water. The water guide channel 30 is designed to allow flush water spouted from the first spout port 22 to swirlingly flow along the inner peripheral surface 18*a* of the rim 8, and formed to extend from the first spout port 22 toward a front end of the bowl portion 8 while gradually inclining downwardly (see FIG. 2) and then extend rearwardly from the front end while gradually inclining upwardly (see FIG. 3). Flush water spouted from the first spout port 22 is guided to swirlingly flow along the water guide channel 30, so that it becomes possible to form a large-flow-rate major stream M (see FIG. 11) which flows from the front end of the bowl portion 8 toward an inlet 32*a* of an aftermentioned introduction conduit portion 32 of the drainage conduit 12.

As illustrated in FIGS. 2 and 3, the drainage conduit 12 comprises an introduction conduit portion 32 connecting with an aftermentioned bottom of the recess 20 and extending rearwardly and obliquely downwardly, and a drainage trap conduit portion 34 connecting with the introduction conduit portion 32 and extending upwardly. The drainage trap conduit portion 34 is composed of a rising section (rising conduit portion) 34*a* and a lowering section (lowering conduit portion) 34*b*.

The introduction conduit portion 32 is formed to have a smooth curved surface continuous with the aftermentioned bottom of the recess 20, so that flush water flowing from the recess 20 into the introduction conduit portion 32 smoothly flows through the introduction conduit portion 32.

Figure 9:
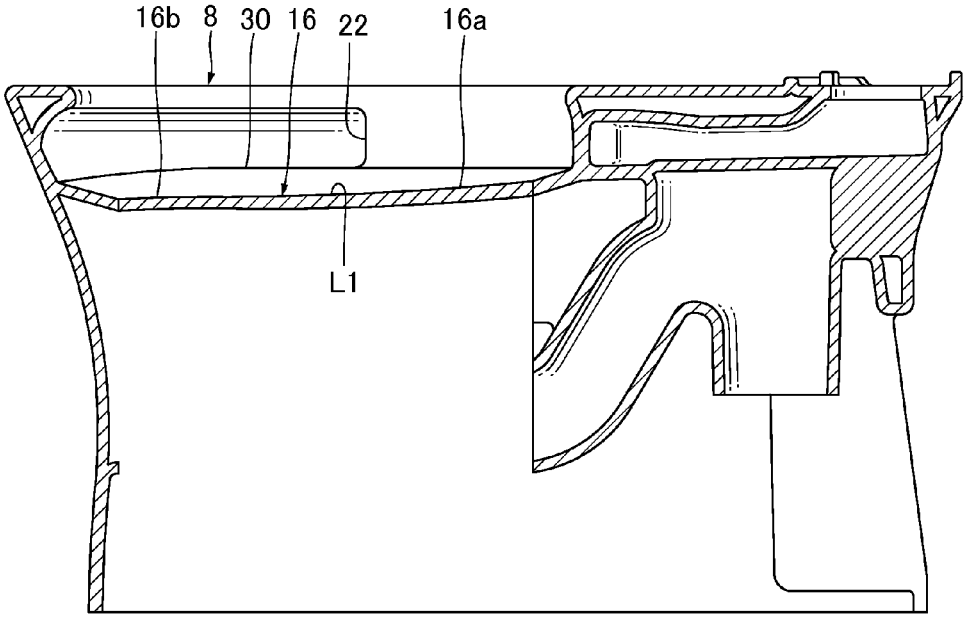
FIG. 9 is a sectional view taken along the line IX-IX in FIG. 1.
Figure 10:
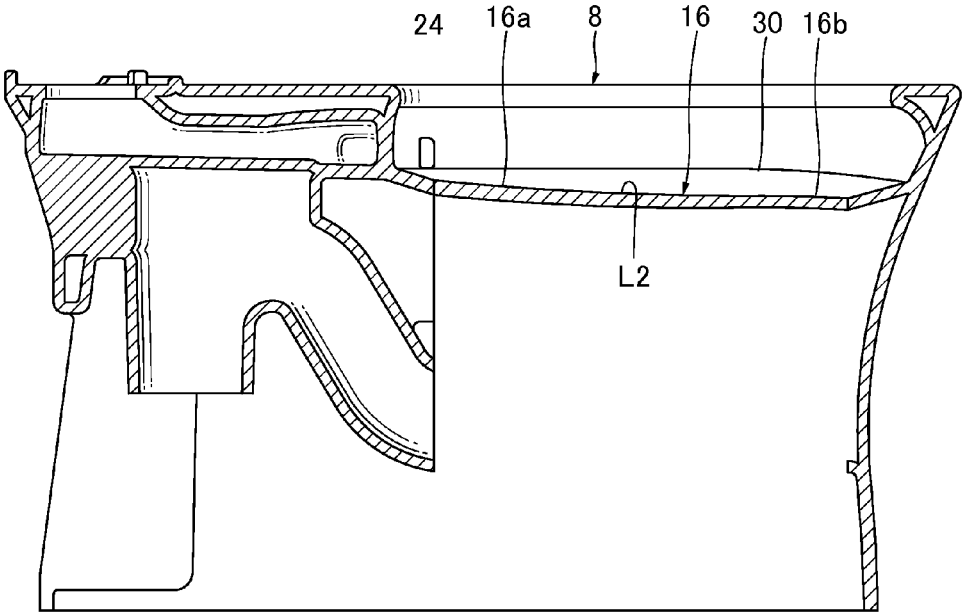
FIG. 10 is a sectional view taken along the line X-X in FIG. 1.
Figure 11:
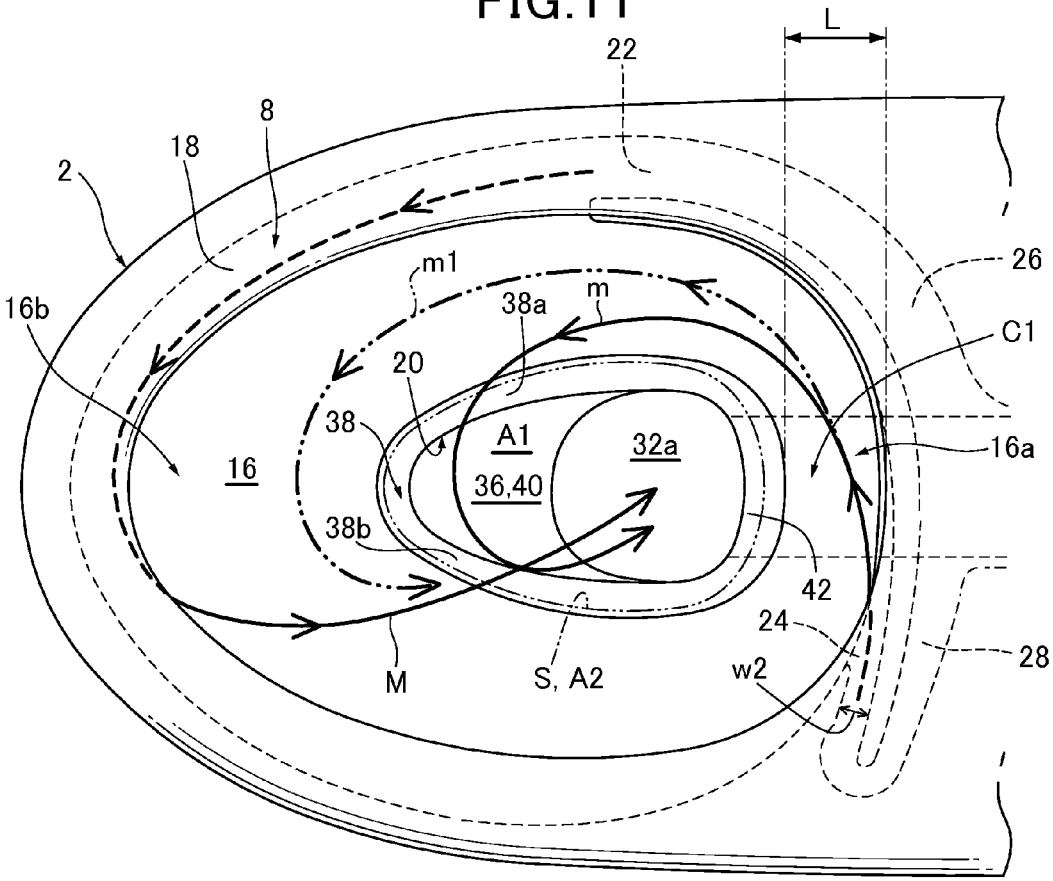
FIG. 11 is a fragmentary enlarged top plan view fragmentarily and enlargedly illustrating a bowl portion of a toilet main unit in the flush toilet according to the embodiment of the present invention illustrated in FIG. 1.

Next, with reference to FIGS. 1 to 7 and 9 to 11, the waste-receiving surface 16 and the recess 20 in the bowl portion 8 will be described in detail. FIG. 9 and FIG. 10 are, respectively, a sectional view taken along the line IX-IX in FIG. 1 and a sectional view taken along the line X-X in FIG. 1, and FIG. 11 is a fragmentary enlarged top plan view fragmentarily and enlargedly illustrating the bowl portion of the toilet main unit in the flush toilet according to the embodiment illustrated in FIG. 1. In a rear waste-receiving sub-surface 16*a* (a region of the waste-receiving surface 16 around a rear end of the bowl portion), and a front waste-receiving sub-surface 16*b* (a region of the waste-receiving surface 16 around the front end of the bowl portion), each of the line IX-IX and line X-X in FIG. 1 lies along a center line extending in a font-rear (longitudinal) direction of the bowl portion at a middle position with respect to a right-left (lateral) direction of the bowl portion. On the other hand, in an intermediate waste-receiving sub-surface (a region of the waste-receiving surface 16 between the rear and front waste-receiving sub-surfaces 16*a*, 16*b*), each of the line IX-IX and the line X-X lies along a line approximately equally distant from the rim 18.

As illustrated in FIGS. 1 to 7 and 9 to 11, the waste-receiving surface 16 is formed to, along lines L1, L2 (see FIGS. 9 and 10) each approximately equally distant from the rim 18 in the intermediate region thereof in the longitudinal direction, extend toward the front end of the bowl portion while gradually inclining downwardly.

Further, as illustrated in FIGS. 2 to 7, the rear waste-receiving sub-surface 16*a* is located adjacent to and on a downstream side of the second spout port 24 in a rear region of the waste-receiving sub-surface 16, and formed in a shelf shape. Thus, a flow (major stream) m of most of flush water spouted from the second spout port 24 to the vicinity of a central area C1 of the rear waste-receiving sub-surface 16*a* is guided to swirlingly flow along the rear waste-receiving sub-surface 16*a*, while passing behind the recess 20 and then passing laterally beside the recess 20 (passing by a left side of the recess 20 when viewed rearwardly from the forward side thereof), and flow into the recess 20 from a lateral end of the bowl portion 8. Then, the flow flowing from the lateral end of the bowl portion 8 into the recess 20 merges with the major stream M formed by the first spout port 22, from a transverse direction of the recess at a position on a lower side of the major stream M.

An amount of flush water to be spouted from the second spout port 24 is set to be less than an amount of large-flow-rate flush water to be spouted from the first spout port 22. For example, 60% to 90% of a total amount of flush water passing through the common water flow passage 10 is spouted from the first spout port 22 via the first water flow passage 26, and 10% to 40% of the total amount of flush water passing through the common water flow passage 10 is spouted from the second spout port 24 via the second water flow passage 28.

Preferably, an amount of the flow (stream) m, i.e., an amount of the most of flush water, to be spouted from the second spout 24, is set to be approximately equal to or greater than 50% of a total amount of flush water to be spouted from the second spout port 24.

A part m1 of the flush water spouted from the second spout port 24 can be directed to merge with the flush water spouted from the first spout port 22 and being flowing, as the large-flow-rate major stream M, from the front end of the bowl portion 8 toward the recess 20, and then flow into the recess 20 from the forward side thereof together with the major stream M.

As illustrated in FIGS. 2, 3 and 11, the recess 20 of the bowl portion 8 has a bottom 36 located below a pooled water level W, and a peripheral wall 38 connecting between the bottom 36 and a lower edge of the waste-receiving surface 16. The bottom 36 has a front bottom surface 40 formed in a region of the recess 20 forward of the inlet 32*a* of the introduction conduit portion 32, and a rear bottom surface 42 formed in a region of the recess 20 rearward of the inlet 32*a* of the introduction conduit portion 32.

The front bottom surface 40 of the bottom 36 of the recess 20 is formed to extend horizontally. Alternatively, the front bottom surface 40 may be formed to gradually incline rearwardly and obliquely downwardly.

The front bottom surface 40 of the recess 20 is formed such that the entire region thereof is located below the pooled water level W, and above a lower end 42*a* of the rear bottom surface 42.

On the other hand, the rear bottom surface 42 of the bottom 36 of the recess 20 is formed to extend toward a front region of the introduction conduit portion 32, while inclining inwardly and obliquely downwardly. The rear bottom surface 42 of the recess 20 is formed such that the entire region thereof is located below the pooled water level W. The rear bottom surface 42 of the recess 20 is not necessarily formed as a flat surface, but may be formed as a curved surface which is slightly curved upwardly convexedly.

As illustrated in FIG. 11, in top plan view, an area A1 of the front bottom surface 40 is set to be greater than one-half of an area A2 of a pooled water surface S. Thus, the flow (major stream) m of most of flush water spouted from the second spout port 24 to the vicinity of the central area C1 of the rear waste-receiving sub-surface 16*a* is guided to swirlingly flow along the rear waste-receiving sub-surface 16*a*, while passing behind the recess 20 and then passing laterally beside the recess 20 (passing by the left side of the recess 20 when viewed rearwardly from the forward side thereof), and form a transverse flow directed toward the inside of the recess 20, as illustrated in FIG. 11. Then, the transverse flush water flow (stream) m dives from a position approximately just above a left wall surface 38*a* of the recess 20, to the front bottom surface 40 along the left wall surface 38*a*.

The flush water flow m which has dived in the recess 20 effectively forms a flow capable of effectively agitating pooled water in an up-down direction while swirlingly flowing upwardly from the front bottom surface 40 along a right wall surface 38*b* of the recess 20. Then, the flow m merges with the large-flow-rate major stream M spouted from the first spout port 22 and flowing from the front end of the bowl portion into the recess 20.

Although this embodiment has been described based on an example where the area A1 of the front bottom surface 40 is set to be greater than one-half of the area A2 of the pooled water surface S, in the top plan view illustrated in FIG. 11, the area A1 of the front bottom surface 40 may be set to be equal to one-half of the area A2 of the pooled water surface S. In other words, the area A1 of the front bottom surface 40 may be set to be equal to or greater than one-half of the area A2 of the pooled water surface S.

Next, based on FIGS. 11 to 13, the first spout port 22 and the second spout port 24 in the bowl portion 8 will be described in detail.

Figure 12:
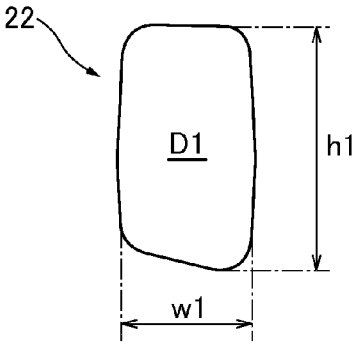
FIG. 12 is a sectional view illustrating a first spout port in the flush toilet according to the embodiment of the present invention.
Figure 13:
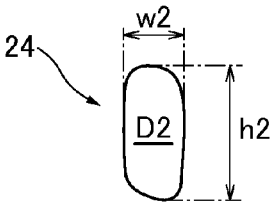
FIG. 13 is a sectional view illustrating a second spout port in the flush toilet according to the embodiment of the present invention.

FIG. 12 is a sectional view illustrating the first spout port in the flush toilet according to this embodiment, and FIG. 13 is a sectional view illustrating the second spout port in the flush toilet according to this embodiment.

As illustrated in FIG. 12, an opening cross-section D1 of the first spout port 22 is formed in a vertically-long flat shape, and a passage cross-section of the first water flow passage 26 reaching the opening cross-section D1 of the first spout port 22 is also formed in a vertically-long flat shape, over approximately the entire region of the first spout port 22. Thus, it becomes possible to allow flush water spouted from the first spout port 22 after passing through the first water flow passage 26 to swirlingly flow until it reaches at least the front end of the bowl portion 8, while avoiding an undesirable situation where most of the flush water falls onto the front waste-receiving sub-surface 16*b* immediately after the spouting, thereby effectively forming the major flow M flowing from the front end of the bowl portion 8 into the recess 20.

In this regard, a ratio of a maximum height dimension h1 to a maximum width dimension w1 (ratio h1/w1) in the opening cross-section D1 of the first spout port 22 is set preferably in the range of 1 to 5, more preferably, in the range of 1.5 to 3.

As illustrated in FIG. 13, an opening cross-section D2 of the second spout port 24 is formed in a vertically-long flat shape, as with the opening cross-section D1 of the first spout port 22, although an area of the opening cross-section D2 is set to be less than that of the opening cross-section D1. Thus, it is possible to allow flush water spouted from the second spout port 24 after passing through the second water flow passage 28 to swirlingly flow until it reaches a position approximately just above the left wall surface 38*a* of the recess 20, while avoiding an undesirable situation where most of the flush water falls from the rear waste-receiving sub-surface 16*a* into a rear region of the recess 20 immediately after the spouting from the second spout port 22.

In this regard, a ratio of a maximum height dimension h2 to a maximum width dimension w2 (ratio h2/w2) in the opening cross-section D2 of the second spout port 24 is set preferably in the range of 1 to 5, more preferably, in the range of 1.5 to 3.

As illustrated in FIGS. 2, 3, 11 and 13, a ratio of a longitudinal width L of the central area C1 of the shelf-shaped rear waste-receiving sub-surface 16*a* to the maximum width w2 of the second spout port 24 (ratio L/w2) is set preferably in the range of 2 to 10, more preferably, in the range of 3 to 9, most preferably, in the range of 4 to 8. Thus, as illustrated in FIG. 11, the flow (major stream) m of most of flush water spouted from the second spout port 24 to the vicinity of the central area C1 of the rear waste-receiving sub-surface 16*a* is guided to swirlingly flow along the rear waste-receiving sub-surface 16*a*, while passing behind the recess 20 and then passing laterally beside the recess 20 (passing by the left side of the recess 20 when viewed rearwardly from the forward side thereof), and form a transverse flow directed toward the inside of the recess 20, and the transverse flow is introduced into the front region of the recess 20, so that it is possible to allow the major stream m of flush water spouted from the second spout port 24 to reliably merge with the major stream M spouted from the first spout port 22, from the transverse direction of the recess 20, thereby effectively agitating pooled water in an up-down direction.

Next, with reference to FIGS. 5 to 7 and 11 again, the waste-receiving surface 16 of the bowl portion 8 will be described in detail.

As illustrated in FIGS. 5 to 7, the waste-receiving surface 16 of the bowl portion 8 is composed of a left waste-receiving sub-surface 44 and a right waste-receiving sub-surface 46 defined, respectively, on both sided of each center line (B1, B2 and B3 indicated, respectively, in FIG. 5, FIG. 6 and FIG. 7) with respect to the lateral direction of the bowl portion 8, more specifically, respectively, on one of the sides which is provided with the first spout port 22, and on the other side devoid of the first spout port 22. Further, the left waste-receiving sub-surface 44 and the right waste-receiving sub-surface 46 are formed, respectively, in different shapes in the front waste-receiving sub-surface 16*b* (see FIG. 11) of the bowl portion 8, so as to allow flush water spouted from the first spout port 22 to form the major stream M which flows from the front end of the bowl portion 8 into the recess 20, and the right waste-receiving sub-surface 46 is formed at a height position lower than the left waste-receiving sub-surface 44.

As illustrated in FIGS. 5 to 7, each of the left waste-receiving sub-surface 44 and the right waste-receiving sub-surface 46 is joined to the recess 20. Further, the left waste-receiving sub-surface 44 and the right waste-receiving sub-surface 46 are formed such that and a curvature radius ρ1 of a joining area P1 between the right waste-receiving sub-surface 46 and the recess 20 become greater than a curvature radius ρ2 of a joining area P2 between the left waste-receiving sub-surface 44 and the recess 20.

Figure 14:
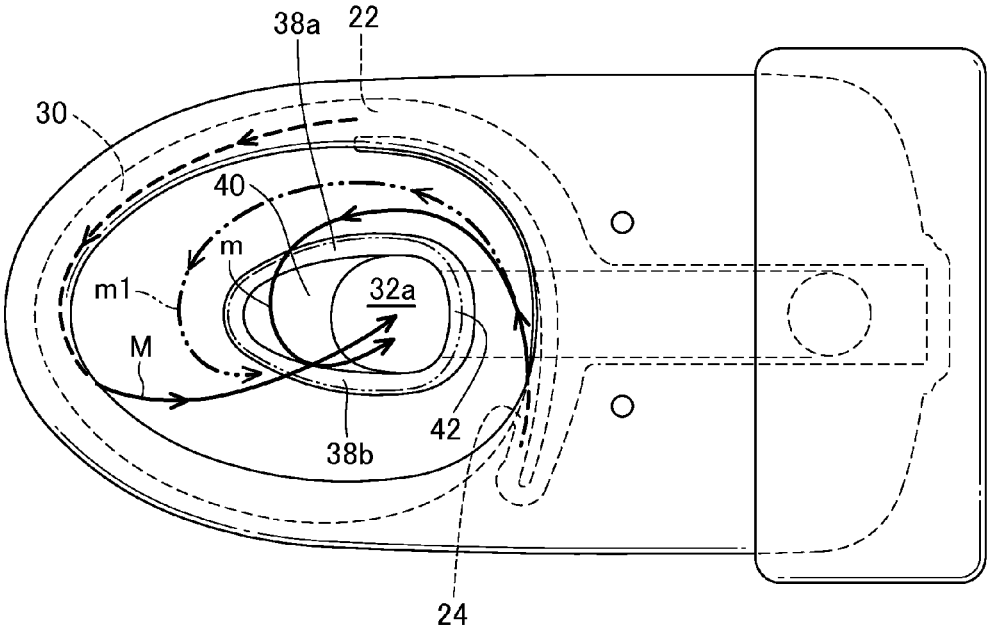
FIG. 14 is a top plan view illustrating a state of a flow of flush water in the flush toilet according to the embodiment of the present invention.
Figure 15:
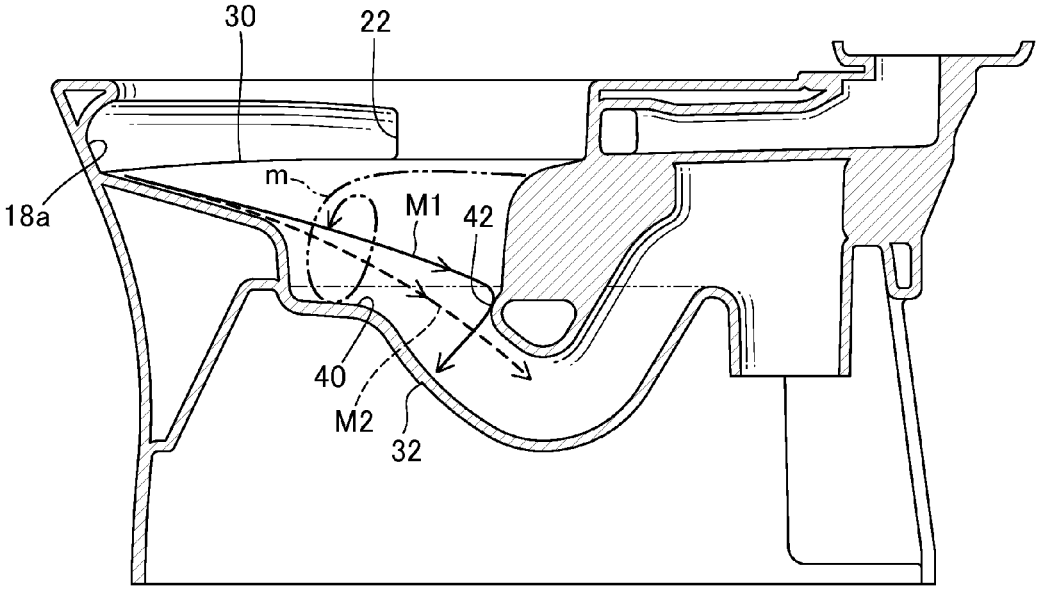
FIG. 15 is a sectional view of the flush toilet in FIG. 14.

Next, with reference to FIGS. 1 to 16, a flushing operation of the flush toilet according to this embodiment will be described. FIG. 14 and FIG. 15 are, respectively, is a top plan view illustrating a state of a flow of flush water in the flush toilet according to this embodiment, and a sectional view of the flush toilet in FIG. 14, and FIG. 16 is a schematic perspective view illustrating a state of a flow of flush water in the flush toilet according to this embodiment.

First of all, when a user operates the manual operation lever (not illustrated) of the reservoir tank 4, the discharge valve 14 is opened, so that flush water in the reservoir tank 4 is supplied to the common water flow passage 10, and spouted from the first spout port 22 and the second spout port 24 via the first water flow passage 26 and the second water flow passage 28 branched from the common water flow passage 10.

Flush water spouted from the first spout port 22 is guided to flow forwardly along the water guide channel 30 formed just below the inner peripheral surface 18*a* of the rim 18 of the bowl portion 8, and then, after passing through the front end of the bowl portion 8, flow rearwardly. In this process, a part of the flush water falls along the bowl portion 8 while swirlingly flowing, thereby flushing or cleaning the waste-receiving surface 16.

Figure 16:
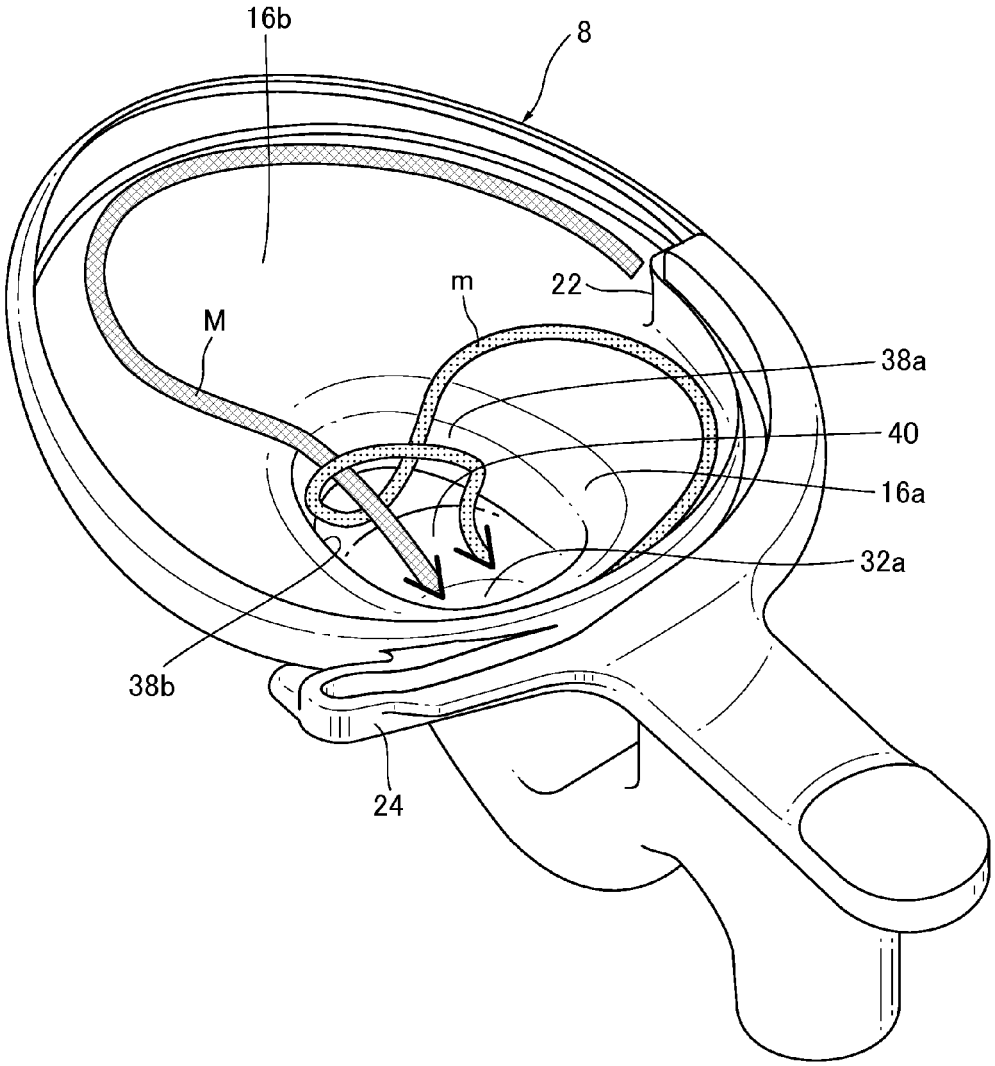
FIG. 16 is a schematic perspective view illustrating a state of a flow of flush water in the flush toilet according to the embodiment of the present invention.

Further, a substantial portion of the flush water spouted from the first spout port 22 and guided to flow along the water guide channel 30 forms a large-flow-rate major stream M which is directed to flow from the front end of the bowl portion 8 toward the inlet 32*a* of the introduction conduit portion 32 of the drainage conduit 12 (see FIGS. 14 and 16). A part M1 of the major stream M collides with the rear bottom surface 42 of the bottom 36 of the recess 20, and then flows out forwardly and obliquely downwardly toward the front region inside the introduction conduit portion 32 (see FIG. 15). On the other hand, a remaining part M2 of the major stream M directly flows into the inlet 32*a* of the introduction conduit portion 32 (see FIG. 15).

In this regard, in this embodiment, the bowl portion 8 is formed with the water guide channel 30 for allowing flush water to swirlingly flow along the inner peripheral surface of the rim 18, wherein the water guide channel 30 is formed to extend from the first spout port 22 toward the front end of the bowl portion 8 while gradually inclining downwardly, and then extend rearwardly from the front end while gradually inclining upwardly, so that it is possible to form the major stream M with a large flow rate. In addition, the part M1 of the major stream M is brought into collision with the rear bottom surface 42 of the bottom 36 of the recess 20, and the collided major stream M1 is guided to flow toward the front region inside the introduction conduit portion 32. Particularly, the rear bottom surface 42 of the bottom 36 is formed to incline inwardly and obliquely downwardly, so that it is possible to smoothly guide the partial major stream M1 after colliding with the rear bottom surface 42, toward the front region of the introduction conduit portion 32. Concurrently, a remaining part M2 of the major stream flows into the rear region of the introduction conduit portion 32.

On the other hand, flush water spouted from the second spout port 24 falls along the bowl portion 8 while swirlingly flowing, thereby flushing or cleaning the rear region of the waste-receiving surface 16. As illustrated in FIGS. 14 to 16, the flow (major stream) m of most of flush water spouted from the second spout port 24 to vicinity of the central area C1 of the rear waste-receiving sub-surface 16*a* is guided to swirlingly flow along the rear waste-receiving sub-surface 16*a*, while passing behind the recess 20 and then passing laterally beside the recess 20 (passing by the left side of the recess 20 when viewed rearwardly from the forward side thereof), and form a transverse flow directed toward the inside of the recess 20.

Further, as illustrated in FIG. 14, the part m1 of the flush water spouted from the second spout port 24 merges with the flush water spouted from the first spout port 22 and being flowing, as the major stream M, from the front end of the bowl portion 8 toward the recess 20, and then flow into the recess 20 from the forward side thereof together with the major stream M.

Then, the transverse flow (major stream) m of flush water flowing into the recess 20 dives from a position approximately just above the left wall surface 38*a* of the recess 20, to the front bottom surface 40 along the left wall surface 38*a*. The flush water flow m which has dived in the recess 20 forms a flow capable of effectively agitating pooled water in the up-down direction, while swirlingly flowing upwardly from the front bottom surface 40 along the right wall surface 38*b* of the recess 20. Then, the flow m of flush water from the second spout port 24 merges with the large-flow-rate major stream M spouted from the first spout port 22 and flowing from the front end of the bowl portion into the recess 20. More specifically, the flow m of flush water from the second spout port 24 is moved upwardly due to the collision with the front bottom surface 40, and mixed with the major streams M1, M2 flowing thereabove. This makes it possible to effectively agitate pooled water with waste to allow the waste to smoothly flow into the introduction conduit portion 32.

In the flush toilet 1 according to the above embodiment of the present invention, the waste-receiving surface 16 of the bowl portion 8 is composed of the left waste-receiving sub-surface 44 and the right waste-receiving sub-surface 46 defined, respectively, on both sided of the center line (B1, B2, B3) with respect to the lateral direction of the bowl portion 8, wherein the left waste-receiving sub-surface 44 and the right waste-receiving sub-surface 46 are formed, respectively, in different shapes in the front region of the bowl portion 8 so as to allow flush water spouted from the first spout port 22 to form the major stream M which flows from the front end of the bowl portion 8 into the recess 20. Thus, it becomes possible to increase a flow rate of the major stream M of flush water flowing from the front end of the bowl portion 8 into the recess 20 and then flowing toward the inlet 32*a* of the drainage conduit 12. This makes it possible to sufficiently flush waste without causing waste to remain inside the bowl portion 8, and efficiently discharge waste in the bowl portion 8 into the drainage conduit 12, thereby improving waste discharge performance.

In the flush toilet 1 according to the above embodiment, the right waste-receiving sub-surface 46 on one of the sides which is devoid of the first spout port 22, is formed at a height position lower than the left waste-receiving sub-surface 44 on the other side provided with the first spout port 22. Thus, it becomes possible to increase a flow rate of the major stream M of flush water flowing into the recess 20 after passing through the front end of the bowl portion 8 and then obliquely flowing toward the inlet 32*a* of the drainage conduit 12. This makes it possible to efficiently discharge waste in the bowl portion 8 into a drainage conduit 12, thereby improving waste discharge performance.

In the flush toilet 1 according to the above embodiment, the left waste-receiving sub-surface 44 and the right waste-receiving sub-surface 46 are formed such that the curvature radius ρ1 of the joining area P1 between the right waste-receiving sub-surface 46 and the recess 20 becomes greater than the curvature radius ρ2 of the joining area P2 between the left waste-receiving sub-surface 44 and the recess 20. Thus, it becomes possible to increase a flow rate of the major stream M of flush water flowing into the recess 20 after passing through the front end of the bowl portion 8, and then obliquely flowing toward the inlet 32*a* of the drainage conduit 12. This makes it possible to efficiently discharge waste in the bowl portion 8 into a drainage conduit 12, thereby improving waste discharge performance.

In the flush toilet 1 according to the above embodiment, the waste-receiving surface 16 is formed to, along the line (L1, L2) approximately equally distant from the rim 18 in the intermediate region of the waste-receiving surface 16 in its longitudinal direction, extend toward the front end of the bowl portion 8 while gradually inclining downwardly. Thus, it becomes possible to sufficiently flush waste without causing waste to remain inside the bowl portion, and increase a flow rate of the major stream of flush water flowing from the front end of the bowl portion 8 into the recess 20 and then flowing toward the inlet 32*a* of the drainage conduit 12. This makes it possible to efficiently discharge waste in the bowl portion 8 into a drainage conduit 12, thereby improving waste discharge performance.

In the flush toilet 1 according to the above embodiment, the first spout port 22 is located on the left side of the bowl portion 8 in the lateral direction, and configured to spout flush water toward the front end of the bowl portion 8 to form a swirl flow which swirlingly flows along the inner peripheral surface 18*a* of the rim 18. On the other hand, the second spout port 24 is located on the right side of the bowl portion 8 in the lateral direction, and configured to spout flush water to form a swirl flow having the same flow direction as that of the swirl flow formable by the first spout port 22. Thus, it becomes possible to sufficiently flush waste without causing waste to remain inside the bowl portion 8, and increase a flow rate of the major stream M of flush water flowing from the front end of the bowl portion 8 into the recess 20 and then flowing toward the inlet 32*a* of the drainage conduit 12. This makes it possible to efficiently discharge waste in the bowl portion 8 into a drainage conduit 12, thereby improving waste discharge performance.

In the flush toilet 1 according to the above embodiment, the left rim spout port 4*ion* and the second rim spout portion are configured to allow flush water spouted from the second rim spout portion to flow into the recess from a lateral side of the bowl portion and then merge with a major stream formed by the first rim spout portion, from a transverse direction of the recess at a position on a lower side of the major stream. Thus, it becomes possible to effectively generate a flow for agitating pooled water within the recess in an up-down direction. This makes it possible to efficiently discharge waste in the bowl portion 8 into a drainage conduit 12 in cooperation with the major stream M flowing from the front end of the bowl portion 8 toward the inlet 32*a* of the drainage conduit 12, thereby improving waste discharge performance.

In the flush toilet 1 according to the above embodiment, the waste-receiving surface 16 of the bowl portion 8 has a rear region including the rear waste-receiving sub-surface 16*b* located adjacent to and on the downstream side of the second spout port 24 and formed in a shelf shape, wherein the rear waste-receiving sub-surface 16*b* is configured to, when flush water spouted from the second spout port 24 flows thereon, guide the flush water to the front region of the recess 20. Thus, it becomes possible to more effectively generate a flow for agitating pooled water within the recess 20 in the up-down direction. This makes it possible to efficiently discharge waste in the bowl portion 8 into the drainage conduit 12 in cooperation with the major stream M flowing from the front end of the bowl portion 8 toward the inlet 32*a* of the drainage conduit 12, thereby improving waste discharge performance.

Although the above embodiment has been described based on an example where the flush toilet 1 is a wash-down type, the flush toilet of the present invention may be a type configured to suck waste in a bowl portion by means of a siphon action so as to discharge the waste to the outside via a drainage trap duct at a burst, so-called "siphon type".

Although the above embodiment has been described based on an example where the first spout port 22 for spouting flush water therefrom is provided at a position slightly rearward of the mid region in the left (in front view) half of the inner peripheral surface of the rim 18 of the bowl portion 8, and the second spout port 24 for spouting flush water therefrom is provided in the rear region in the right (in front view) half (in the downstream region) of the inner peripheral surface of the rim 18, the arrangement of he first spout port 22 and the second spout port 24 may be reversed in the lateral direction with respect to the center line (B1, B2, B3). In this case, the left waste-receiving sub-surface 44 may be provided at a height position lower than the right waste-receiving sub-surface 46, and the curvature radius ρ1 of the joining area P1 between the right waste-receiving sub-surface 46 and the recess 20 becomes less than the curvature radius ρ2 of the joining area P2 between the left waste-receiving sub-surface 44 and the recess 20.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet capable of flushing a toilet main unit with flush water supplied from a flush water source to thereby discharge waste, comprising:

a bowl portion having a bowl-shaped waste-receiving surface, a rim located along an upper edge thereof, and a recess formed below the waste-receiving surface, the recess having a bottom located below a pooled water level, and a peripheral wall connecting between the bottom and a lower edge of the waste-receiving surface;

a rim spout portion configured to spout flush water along an inner peripheral surface of the rim exposed to an internal space of the bowl portion to form a swirl flow which swirlingly flows along the inner peripheral surface; and a drainage conduit having an inlet connecting with the recess to discharge waste therethrough, wherein the waste-receiving surface of the bowl portion is composed of a left waste-receiving sub-surface and a right waste-receiving sub-surface defined, respectively, on both sided of a center line with respect to a lateral direction of the bowl portion, the left waste-receiving sub-surface and the right waste-receiving sub-surface being formed, respectively, in different shapes in a front region of the bowl portion so as to allow flush water spouted from the rim spout portion to form a major stream which flows from a front end of the bowl portion into the recess.

2. The flush toilet as defined in claim 1, wherein one of the left waste-receiving sub-surface and the right waste-receiving sub-surface of the waste-receiving surface is a first waste-receiving sub-surface defined on one of the sides which is provided with the rim spout portion, and a remaining one of the left waste-receiving sub-surface and the right waste-receiving sub-surface of the waste-receiving surface is a second waste-receiving sub-surface on the other side devoid of the rim spout portion, and wherein the second waste-receiving sub-surface is formed at a height position lower than the first waste-receiving sub-surface.

3. The flush toilet as defined in claim 2, wherein each of the first waste-receiving sub-surface and the second waste-receiving sub-surface is joined to the recess, and wherein the first waste-receiving sub-surface and the second waste-receiving sub-surface are formed such that a curvature radius of a joining area between the second waste-receiving sub-surface and the recess becomes greater than a curvature radius of a joining area between the first waste-receiving sub-surface and the recess.

4. The flush toilet as defined in claim 1, wherein the waste-receiving surface is formed to, along a line approximately equally distant from the rim in an intermediate region of the waste-receiving surface in its longitudinal direction, extend toward the front end of the bowl portion while gradually inclining downwardly.

5. The flush toilet as defined in claim 1, wherein the rim spout portion comprises:

a first rim spout portion located on one of laterally opposite sides of the bowl portion, and configured to spout flush water toward the front end of the bowl portion to form a swirl flow which swirlingly flows along the inner peripheral surface of the rim; and a second rim spout portion located on the other side of the bowl portion, and configured to spout flush water to form a swirl flow having a same flow direction as that of the swirl flow formable by the first rim spout portion.

6. The flush toilet as defined in claim 5, wherein the first rim spout portion and the second rim spout portion are configured to allow flush water spouted from the second rim spout portion to flow into the recess from a lateral side of the bowl portion and then merge with a major stream formed by the first rim spout portion, from a transverse direction of the recess at a position on a lower side of the major stream.

7. The flush toilet as defined in claim 6, wherein the waste-receiving surface of the bowl portion has a rear region including a rear waste-receiving sub-surface located adjacent to and on a downstream side of the second rim spout portion and formed in a shelf shape, the rear waste-receiving sub-surface being configured to, when flush water spouted from the second rim spout portion flows thereon, guide the flush water to a front region of the recess.

* * * * *